US007559437B2

(12) United States Patent
Colelli et al.

(10) Patent No.: US 7,559,437 B2
(45) Date of Patent: Jul. 14, 2009

(54) MERCHANDISE DISPENSER WITH COIL ACTUATION

(75) Inventors: Robert P. Colelli, Yorba Linda, CA (US); Eric E. Oberg, Long Beach, CA (US); Johnnie Cruz, Anaheim, CA (US); Keith Cleland, Costa Mesa, CA (US)

(73) Assignee: Displays Plus, Inc., Placentia, CA (US)

( * ) Notice: Subject to any disclaimer, the term of this patent is extended or adjusted under 35 U.S.C. 154(b) by 0 days.

(21) Appl. No.: 11/999,802

(22) Filed: Dec. 7, 2007

(65) Prior Publication Data

US 2009/0145918 A1 Jun. 11, 2009

(51) Int. Cl.
*A47F 1/00* (2006.01)

(52) U.S. Cl. ..... 221/312 A; 221/75; 221/89; 221/277; 211/1

(58) Field of Classification Search ..... 221/1–312 C; 700/231–244; 211/7
See application file for complete search history.

(56) References Cited

U.S. PATENT DOCUMENTS

| | | | | | |
|---|---|---|---|---|---|
| 1,922,989 | A | * | 8/1933 | Terry | 211/88.04 |
| 2,954,128 | A | | 9/1960 | Gordon | |
| 3,248,005 | A | * | 4/1966 | Joschko | 221/13 |
| 3,572,546 | A | * | 3/1971 | Schlaf | 221/75 |
| 3,773,217 | A | * | 11/1973 | Schlaf | 221/75 |
| 4,312,460 | A | * | 1/1982 | Boettcher | 221/75 |
| 4,566,598 | A | | 1/1986 | Fors | |
| 4,600,119 | A | | 7/1986 | Olson | |
| 4,638,922 | A | * | 1/1987 | Stoltz | 221/75 |
| 4,706,821 | A | | 11/1987 | Kohls et al. | |
| D300,994 | S | | 5/1989 | Wolff | |
| 4,830,201 | A | | 5/1989 | Breslow | |
| 4,944,414 | A | | 7/1990 | Albright | |
| 5,070,986 | A | | 12/1991 | Hoffman et al. | |
| 5,307,941 | A | | 5/1994 | Siegal | |
| 5,649,641 | A | | 7/1997 | Campoli | |
| 6,659,291 | B2 | * | 12/2003 | Huehner et al. | 211/4 |
| 7,017,778 | B2 | | 3/2006 | Halbherr | |
| 7,108,180 | B2 | | 9/2006 | Brusso et al. | |
| 7,137,513 | B2 | * | 11/2006 | Sedon et al. | 211/59.1 |
| 7,178,678 | B2 | * | 2/2007 | Mansfield et al. | 211/7 |
| 7,287,669 | B2 | * | 10/2007 | Takeda | 221/312 A |
| 7,377,402 | B2 | * | 5/2008 | Takeda | 221/312 A |
| 2005/0161420 | A1 | | 7/2005 | Hardy et al. | |
| 2006/0240398 | A1 | | 10/2006 | Hardy et al. | |
| 2007/0080123 | A1 | | 4/2007 | Mason | |

* cited by examiner

*Primary Examiner*—Gene Crawford
*Assistant Examiner*—Michael K Collins
(74) *Attorney, Agent, or Firm*—Gene Scott; Patent Law & Venture Group

(57) ABSTRACT

A theft-deterring merchandise dispensing apparatus has a chassis configured to provide limited access to an interior space housing merchandise in a secure manner. A knob is secured to a front panel of the chassis. The knob is secured to one end of an elongate wire coil, the knob and coil rotational about a common axis. An elongate cantilevered rod is mounted on a rear panel of the chassis and extensive therefrom within the coil, the rod terminating at a free end in proximity to the front panel. Units of merchandise are slidingly secured on the rod and positioned between windings of the coil so that rotation of the coil by the knob moves the packages along the rod to exit proximate the front panel. A noise-maker creates a noise when the knob is rotated to alert store personnel that products are being dispensed.

10 Claims, 4 Drawing Sheets

MERCHANDISE DISPENSER WITH COIL ACTUATION

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

SEQUENCE LISTING

Not applicable.

BACKGROUND OF THE INVENTION

1. Field of the Present Disclosure

This disclosure relates generally to commercial packaged merchandise dispensing devices such as vending machines, J-hook package mounted, and the like; and more particularly to an apparatus for displaying and dispensing such merchandise in a theft deterring manner.

2. Description of Related Art Including Information Disclosed under 37 CFR 1.97 and 1.98

Hardy et al, US 2005/0161420 and US 2006/0240398, discloses a system for managing and securing product and deterring theft in a retail setting, which includes a system that resides either on a standard retailer shelf or may be a standalone system. The system includes shelves, product dividers and front retaining walls of a height and position to inhibit access to displayed products. Individual taller retaining tabs may be added in front of taller product to inhibit access. Rigid or moveable barriers may be positioned above retaining walls to further restrict access. Thus, with the invention, the "sweeping" of numerous products by a thief is deterred.

Mason, US 2007/0080123, discloses a shelf unit for displaying products in a space-saving manner which includes brackets for securing to a support and a tray extending between the brackets. The tray has a front portion with edges arranged so that adjacent edges are disposed at alternating angles to form a saw-tooth pattern. A face portion configured to conform to the front portion is disposed over the front portion and has a window for viewing a product disposed behind the window. Adjustable partitions are disposed on the tray and define rows for displaying the products. A biasing mechanism biases the products in the row toward a front of the shelf unit. Each biasing mechanism has a biasing element and a slidable product advancing member. The products are arranged in adjacent rows at alternating angles to form a saw-tooth pattern corresponding to the edges of the front portion of the tray.

Gordon, U.S. Pat. No. 2,954,128, discloses a display and dispensing device comprising a clamp bracket including confronting upper and lower arms joined by a knee portion along their leading edges and being resiliently urged toward each other, said clamp bracket being adapted to embrace a shelf between said arms, a latching arm pivotally mounted on said lower bracket arm posterior to the leading edge thereof and having a forwardly directed free end swingable toward and away from said bracket upper arm, spring means urging said latching arm to its upper position and a longitudinally extending tray disposed below and secured to said bracket.

Schlaf, U.S. Pat. No. 3,773,217, discloses a machine for displaying and dispensing bagged products that includes a rectilinear housing which is open at its top and at one end. The opposite end of the housing is closed and supports three helices, two of which extend through the upper portion of the housing adjacent to the sides thereof, while the third is centered with respect to the two upper helices but is located below them and rests on the bottom wall of the housing. The three helices are connected through a drive train at the closed end of the housing and rotate at the same angular velocity. An electric motor drives a hub forming part of the drive train and thereby rotates the three helices. The bags are fitted between the convolutions of the three helices with the upper helices engaging the sides of the bags and the lower helix engaging the bottom of the bags, and accordingly the bags are arranged in an orderly succession and display in an upright position. One full revolution of the helices drives the endmost bag out of the open end of the housing, thus dispensing that bag, and advances each of the remaining bags one convolution.

Fors, U.S. Pat. No. 4,566,598, discloses an arrangement in display and storage racks with swingable frames particularly for easily stolen and difficultly displayed articles, including at least one shelf space, having means for preventing unauthorized removal of the articles from the rack. The means comprise projections or flanges projecting from the upper and lower portions of the shelf space and over the edge portions of the article, at least one of said projections being movable vertically such that an article is removable from the shelf space after the flange has first been displaced to a position outside the edge portion of the article.

Olson, U.S. Pat. No. 4,600,119, discloses an apparatus for dispensing small items. A removable dispensing tray has a spiral ejector, each coil of which is loaded with one item. The dispensing tray is placed in position on its dispensing station, which station has a drive motor to rotate the spiral ejector. Upon an activating signal, the motor rotates the ejector one time, causing one item to be dispensed. The dispensing tray includes a tray latching bar which latches to a station latching bar to hold the dispensing tray.

Kohls et al, U.S. Pat. No. 4,706,821, discloses a merchandise display and dispensing device that includes a frame which carries at least one shelf. The shelf defines a slot, and the shelf supports a push plate which includes an upstanding section and a guide section oriented parallel to the shelf. The push plate is disposed on the shelf over the slot. Four low friction glides are mounted to the guide section of the push plate to bear on an upper planar surface of the shelf to support the push plate on the shelf and to reduce sliding friction therebetween. First and second guide pins are mounted to the push plate to extend through the slot and thereby guide sliding motion of the push plate on the shelf. The guide pins have enlarged heads sized to bear against the lower surface of the shelf to hold the push plate in place. A spring is mounted between the push plate and the shelf to bias the push plate toward a first end of the slot.

Breslow, U.S. Pat. No. 4,830,201, discloses a shelf divider system comprising a divider wall mountable in a channel member secured to the front of a shelf. A spring-urged pusher member is slidably mounted on a track having a pair of rails integral with the divider shaft. In one embodiment, the operationally mounted divider wall is vertically oriented and the pusher member extends horizontally therefrom so that displayed merchandise resets directly on the shelf surface but is automatically urged forwardly by the retracted pusher member. In another embodiment, the track provides the supporting surface for displayed merchandise and a vertical divider wall is integrally formed with the track.

Albright, U.S. Pat. No. 4,944,414, discloses an imposed shelf arrangement for vending tubular products such as cans and the like comprising a tray having a base, a rear panel and a pair of side panels or dividers forming a longitudinally disposed product feed trough having a width equal substantially to twice the length of a tubular product; a helix disposed centrally within said feed trough and adapted to receive a plurality of tubular products between the convolutions thereof in a staggered relationship whereby the inner end of each tubular product is adapted to be disposed along the longitudinal axis of said trough; and a drive unit at the rear of the base for rotating said helix whereby to advance said tubular products one by one to the front edge of said base to drop to a delivery position.

Wolff, U.S. Pat. No. D300,994, discloses a design for a modular dispenser tray.

Hoffman et al, U.S. Pat. No. 5,070,986, discloses a vending device for vending machines comprising a spiral coil connected to a coin-operated mechanism that allows rotation thereof and the connected coil when predetermined coins have been inserted into the mechanism. The loops making up the coil comprise closely spaced neighboring loops, remote from the mechanism, capable of supporting and transporting product to be vended as the coil is rotated, and distantly spaced neighboring loops, incapable of supporting the product. As the coil is turned, product is transported toward the mechanism until it reaches the distantly spaced loops where it drops from the spiral into a chute accessible by the purchaser. The mechanism is rotated by coin receivers that are blocked from rotating by spring-urged pawls unless predetermined coins have been inserted therein, or unless disabling tabs are interposed between the receivers and the pawls. Interposition of appropriate tabs permits price changes to be effected by preventing the pawls from stopping the rotation of coin receivers thus disabled.

Siegal, U.S. Pat. No. 5,307,941, discloses a file folder conveyor which comprises a rotatable spiral mounted in a base that has opposite ends and has a back wall which extends higher than the front wall such that as the spiral is rotated, files can be moved which rest in the spiral and extend out of the front of the base so that they can be easily removed by a user. The spiral may be driven manually or by a motor means.

Campoli, U.S. Pat. No. 5,649,641, discloses a system for maintaining and dispensing articles in an aseptic environment. The system includes a cabinet of modular units having at least one bank of shelves. Each bank has an open end and a closed end such that the open end is oriented toward a dispensing chute. Each bank contains a plurality of horizontally adjustable shelves laterally disposed in the bank. The shelves are divided by a plurality of dividers to define a series of slots on each shelf. A dispensing chute is located adjacent the open end of the bank and is adapted to provide gravity feed of an article. The articles are feed toward the dispensing chute by a feeding means such as an auger and the leading article is discharged by gravity. The operation of the feed means is controlled by a microprocessor or the like to control the delivery of articles to the dispensing chute. There is also disclosed a prepackaged cartridge of articles for use in the dispensing system.

Halbherr, U.S. Pat. No. 7,017,778, discloses a display dispenser having a disposable molded tray with a thin shell, unibody construction that firmly receives a removable pusher assembly. The tray is formed from a unitary sheet of plastic that forms inner and outer shells. Each shell forms the inside or outside half of a continuous wall around the perimeter of the tray. The two wall halves are integrally joined along a top portion, but otherwise spaced apart to provide a double-walled construction. Each wall has a frusto-conical shape so that the trays nest into each other when stacked. The inner shell has an interior portion with two symmetrical side ledges that support and align the sides of the packages. The top of the package faces forward to show the artistic design on the article such as the paper plates or paper napkins inside. The inner shell has a central recess that snugly receives the unified pusher assembly. A rim extending from the wall and a floor of the recess lay flat on a surface of a shelf.

Brusso et al, U.S. Pat. No. 7,108,180, discloses one of a number of automatic vending machines run by one or more operators which accepts payment for the goods it dispenses by creditable and debitable cash card, also called smart card. The machine includes a currency acceptor that writes on the card the sum in bank notes received by the currency acceptor. With each purchase, the given price of selected and dispensed goods is deducted from the card. The amount of payment received by the currency acceptor and the price charged are recorded by the machine and communicated to an account clearing house that debits the operator's account with the sum received and credits it by the charged price. A large number of goods and service providers using this type of automatic vending machines can accept the same universal card for the convenience of their customers.

The related art described above discloses various types of merchandise dispensing devices that utilize a helical coil to hold and dispense product between coil windings. However, the prior art fails to disclose such a device that utilizes a rod and coil combination, hanging product from the rod between windings and dispensing the product by manually rotating a knob equipped with a noise making mechanism. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

Shoplifting has become an ever-increasing problem for retail stores. When products are simply placed on shelves, thieves are able to quickly and easily grab an armful of merchandise (often referred to as "sweeping") and run out of the store, sometimes before a store employee even realizes what has transpired. One solution that stores have implemented is to keep valuable merchandise locked inside protective display cases. Thus, when a customer wants to purchase one of these items, they must first find an employee to unlock the display case. While this is a secure method, it is not time or labor efficient and is not satisfactory to the consumer who is inconvenienced.

The present invention provides a solution to this problems by providing an inexpensive theft-deterring apparatus and method. The apparatus comprises a chassis having a plurality of panels positioned and configured to prevent access from several directions to an interior space stocked with merchandise. A knob mounted on a front of the apparatus is rotated by the consumer to move a next merchandise package to a release position whereupon it is dropped from a mounting rod. Units of merchandise are hung from the rod and positioned between windings of a coil so that rotation of the coil by the knob moves the packages along the rod to exit proximate the front panel. The apparatus further provides a noise making mechanism so that retail store personnel are able to hear customers accessing products. If repetitive or incessant ejection noises are heard, store personnel may become alarmed and investigate the situation before too many merchandise packages of high value goods are dispensed.

A primary objective inherent in the above described apparatus and method of use is to provide advantages not taught by the prior art.

Another objective is to provide a merchandise dispenser that prevents product theft by securing products within an enclosure and mounted on a rod.

A further objective is to provide such a dispenser that accommodates merchandise packages having a wide range of widths and thicknesses.

A still further objective is to provide such a dispenser that secures back-stocked merchandise while allowing a first in line package to be dispensed.

A still further objective is to provide such a dispenser that causes a tell-tail noise when an item is being dispensed.

A still further objective is to provide such a dispenser that can be mounted onto a variety of pre-existing types of merchandise mounts such as peg boards.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the apparatus and its method of use in at least one of its preferred, best mode embodiment, which is further defined in detail in the following description. Those having ordinary skill in the art may be able to make alterations and modifications to what is described herein without departing from its spirit and scope. Therefore, it should be understood that what is illustrated is set forth only for the purposes of example and that it should not be taken as a limitation to the scope of the present apparatus and method of use.

Figure 1:
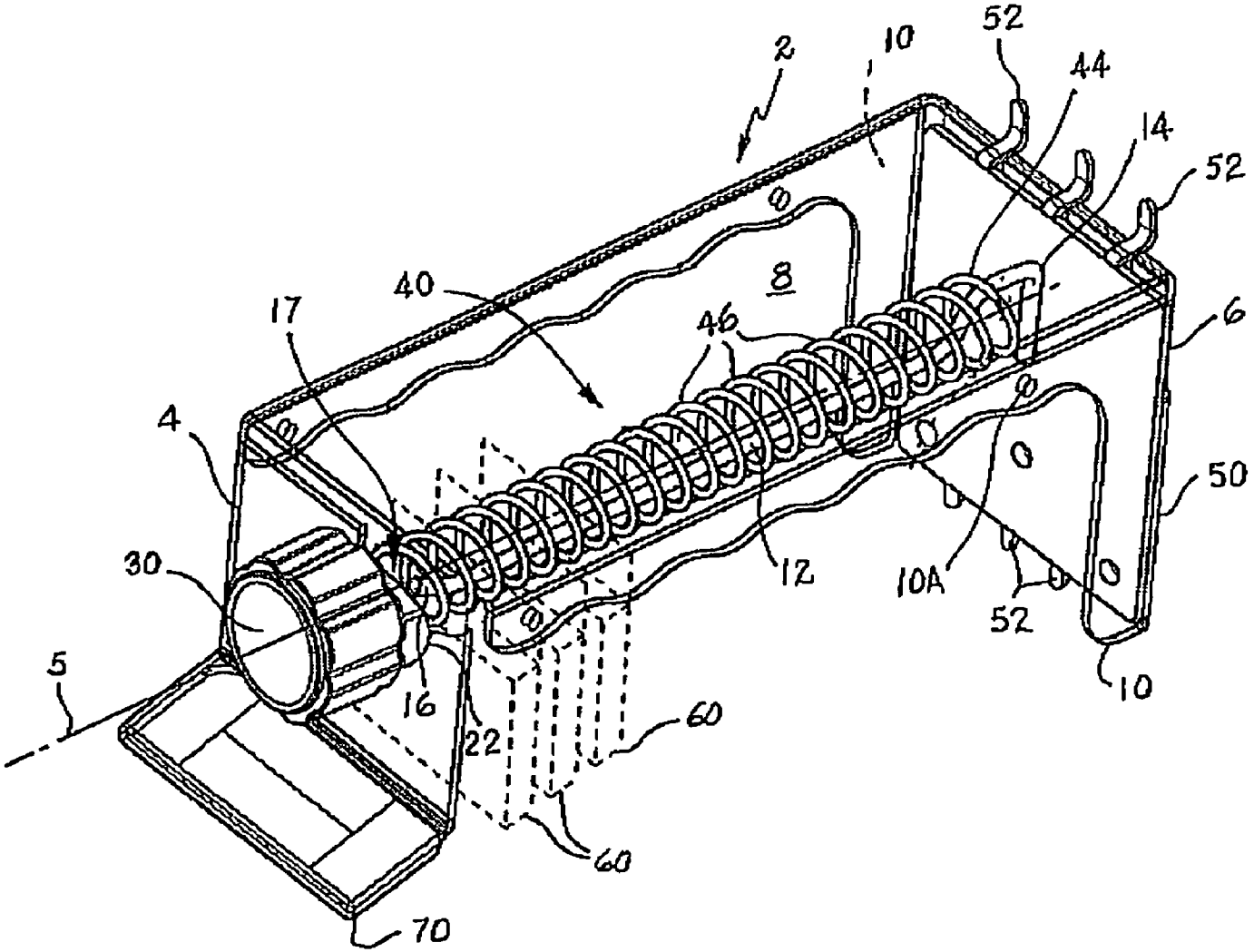
FIG. 1 is a perspective view of the presently described apparatus showing merchandise packages in dashed line as mounted on a rod of the apparatus.

Described now in detail is a merchandise dispenser with a coil actuation primarily designed for use in a retail store to dispense merchandise items. As shown in FIG. 1, the apparatus comprises a chassis 2 having front 4, rear 6, top 8, and side 10 panels. The chassis 2 is preferably made out of a transparent material, such as plastic, to allow for greater visibility of merchandise 60, also referred to herein as "merchandise package" or "package"; however, other structural materials may be substituted. In this disclosure, the front panel 4 shall be considered to be located at a proximal end of the apparatus, while the rear panel 6 will be referred to as located at the distal end of the apparatus, and all other elements may be discussed as oriented in this manner. As described below, both a generally linear rod 12, and a helical coil 40 are aligned with a common axis 5.

Figure 2:
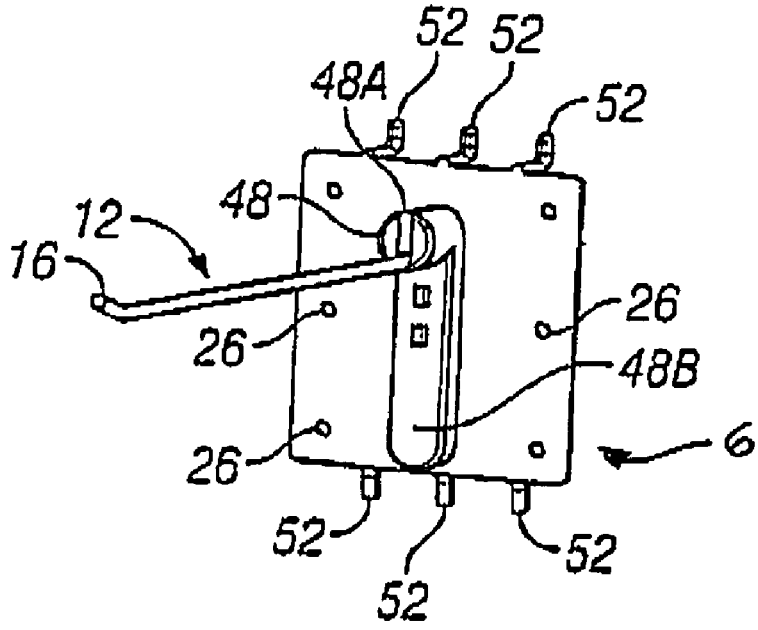
FIG. 2 is a perspective view thereof showing a rear panel of the apparatus with the rod extending therefrom.
Figure 3:
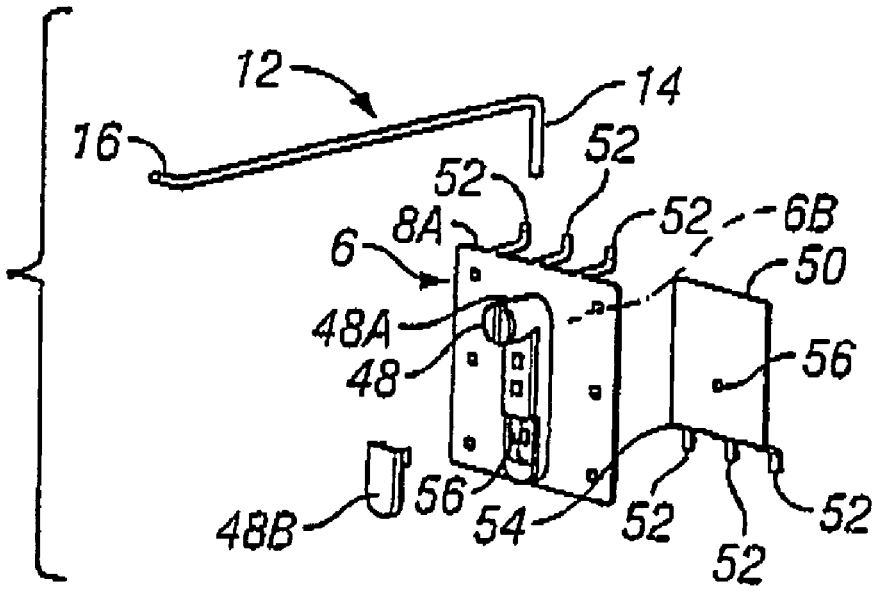
FIG. 3 is an exploded view of FIG. 2.

A distal end 14 of the cantilevered rod 12 is engaged with the rear panel 6. Preferably the distal end 14 is L-shaped, as shown so that, in the embodiment of FIG. 1, it may be welded to rear panel 6, or, as shown in FIG. 2, it may be secured in a slot 48A of a circular standoff 48 which is mounted securely to, and extensive from the rear panel 6. The rod 12 extends proximally from the rear panel terminating at a free end 16 proximate front panel 4. Preferably the free end 16 is angled upwardly, as shown in FIGS. 1-3, to secure merchandise 60 on rod 12 until it is pushed off the free end 16 by coil 40. Element 17 is shown with an arrow pointing to a selected space 17 between free end 16 and front panel 4 wherein selected space 17 is large enough for merchandise packages 60 to dismount from rod 12 as they are pushed by coil 40 toward front panel 4.

Figure 4:
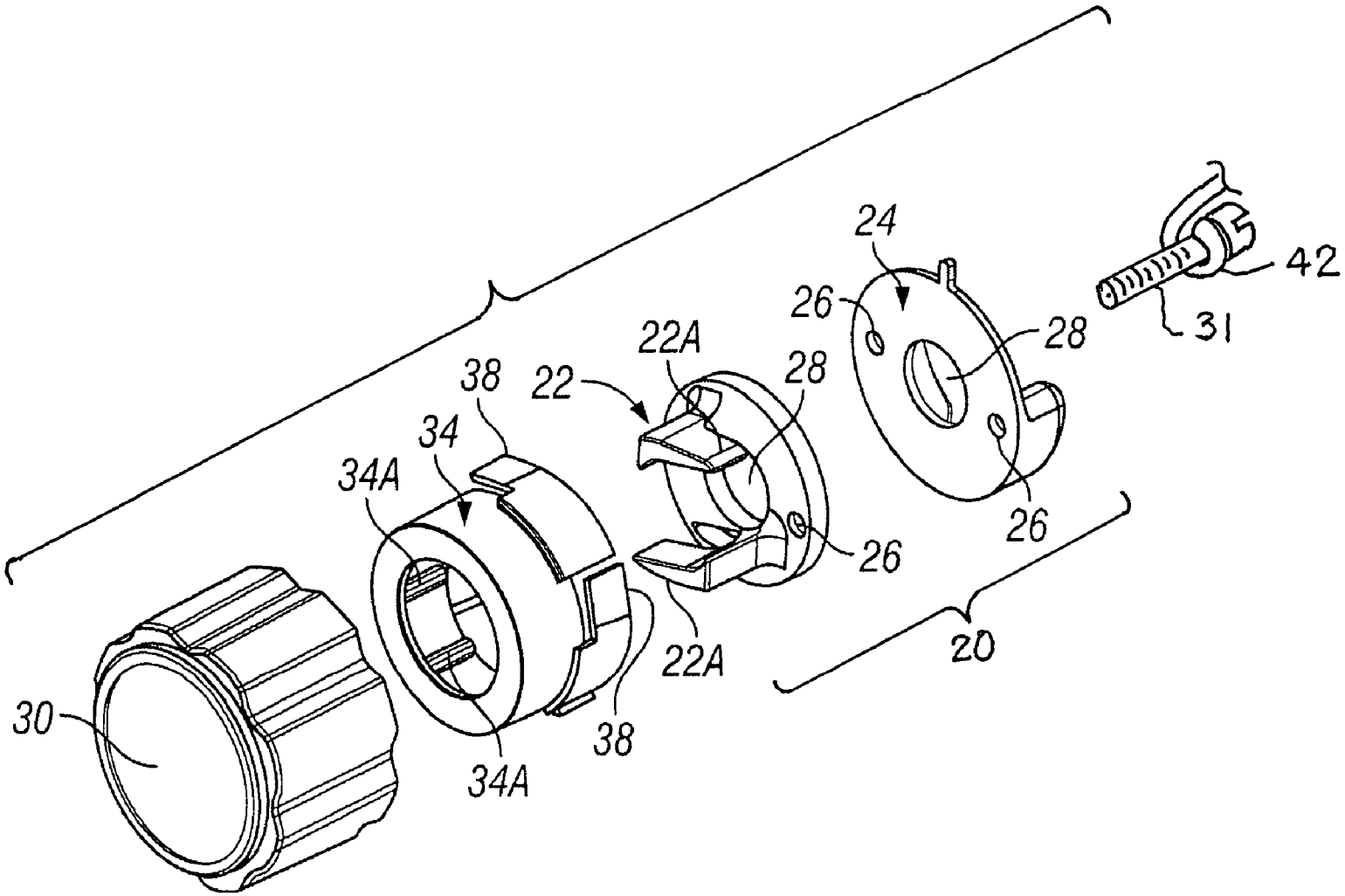
FIG. 4 is a perspective exploded view of portions of the invention including a knob, knob insert, first and second portions of a knob mount, a fastener and a portion of a coil, the portions shown in assembly order.

A knob mount 20 is secured to the front panel 4. Shown in detail in FIG. 4, the knob mount 20 includes a first mount piece 22 and a second mount piece 24. The first mount piece 22 abuts front panel 4 on its outside surface, while the second mount piece 24 abuts the front panel 4 on its inside surface. Both mount piece 22 and 24, as well as the front panel 4 provide corresponding apertures 26 through which hardware, such as screws (not shown), are threaded in order to join the mount pieces 22 and 24 thereby sandwiching the front panel 4 between them. The knob mount 20 provides medial knob apertures 28 which are aligned with a similar front panel aperture (not shown).

Figure 5:
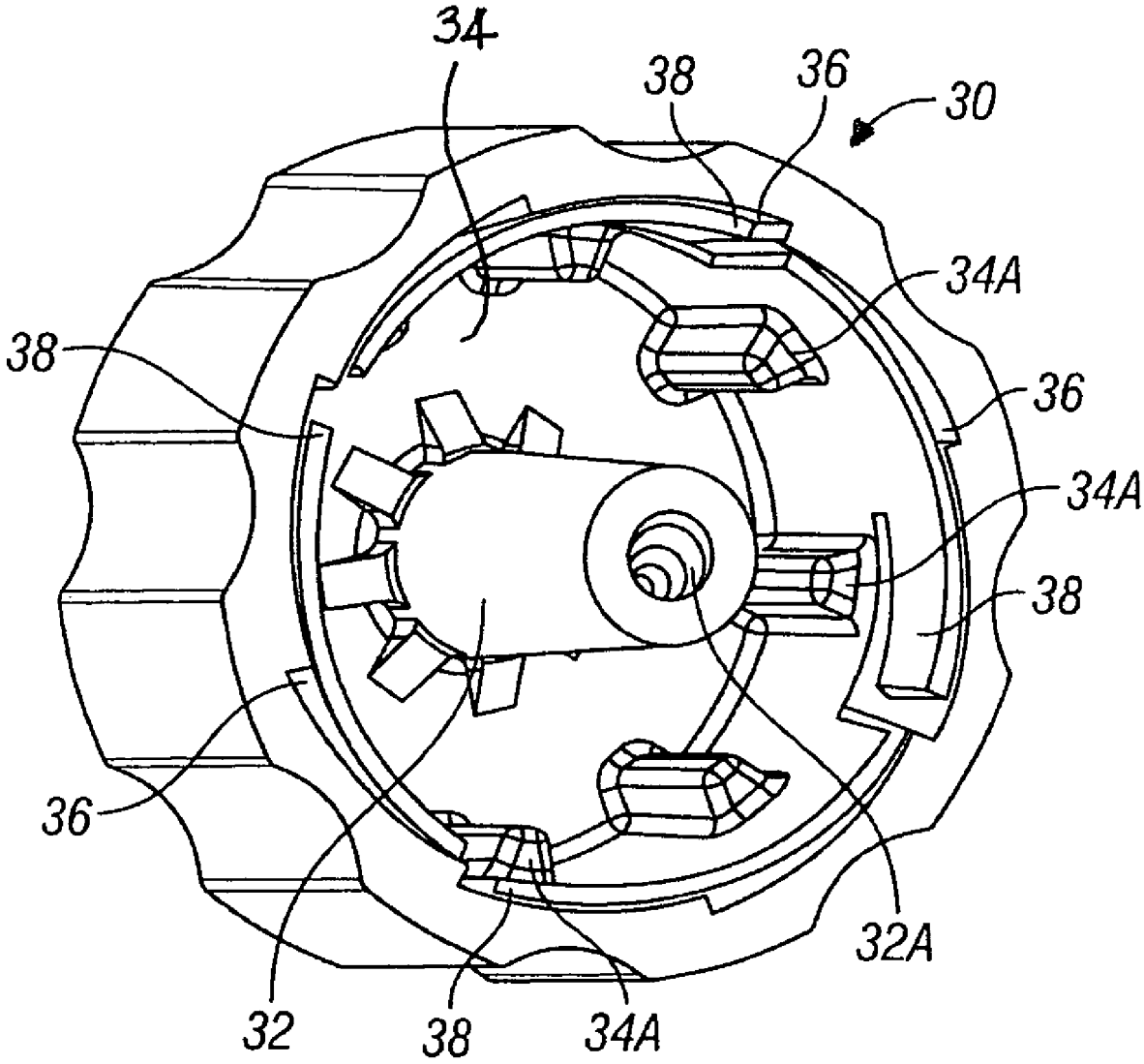
FIG. 5 is a perspective view of the knob showing an interior detail thereof.

As shown in FIG. 5, a knob 30 provides an axial knob stem 32 having an internal thread 32A. The knob 30 is secured to a proximal end 42 of coil 40 by a screw 31 which extends through apertures 28 and threadedly engages internal thread 32A of stem 32. The coil 40 extends from screw 31 distally to terminate approximate rear panel 6, and provides a plurality of uniformly sized windings 46. Preferably, the proximal end 42 of coil 40 has a squared and ground surface allowing it to abut the second mount piece 24, creating a tight engagement with the knob stem 32. Secured together, the knob 30 and coil 40 are rotational about the common axis 5.

In a first embodiment, shown in FIG. 1, the distal end 44 of coil 40 rests on the distal end 14 of rod 12, which controls the location of coil 40 as it rotates. In a second embodiment, referring now to FIG. 2, coil 40 is coaxially engaged with standoff 48 which controls the location of coil 40 during rotation.

On an exterior surface 6B of rear panel 6, an indented area (not visible), accept a mounting plate 50. As shown in FIGS. 2 and 3, the mounting plate 50 is removably engaged with the rear panel 6 and provides a plurality of L-shaped fingers 52 extensive from an edge 54. In addition the exterior surface 6B provides a corresponding set of opposingly directed L-shaped fingers 52 on a top edge 8A of the rear panel 6. The fingers 52 are sized to allow the rear panel 6 to be mounted into a wide range of standard retail store merchandise shelf wall panels, including peg board, grid, and slat wall panels. Preferably the mounting plate 50 is removably secured to the rear panel 6 using hardware such as screws. As shown in FIG. 3, both the rear panel 6 and the mounting plate 50 provide apertures 56 to enable hardware securement. Once the apparatus is mounted on a store wall, the mounting hardware (not shown) is concealed by a cover 48B.

In use, merchandise 60 is hung from rod 12 and positioned between the windings 46 so that rotation of the coil 40 by knob 30 moves the merchandise 60 along the rod 12 to be dispensed at the free end 16. Thus, to remove a unit of merchandise 60 from the apparatus, the knob 30 is turned clockwise. To load merchandise 60 onto the rod 12, the knob 30 is turned counter-clockwise. A single unit of merchandise 60 is loaded between each winding 46, requiring a customer to turn the knob 30 multiple times in order to obtain multiple units of merchandise 60. This prevents a thief from quickly and easily grabbing an armful of merchandise 60.

A further theft deterrent is created by a noise making mechanism provided by the knob 30, a knob insert 34 and the knob mount 20, which work together to create a distinctive cracking noise. The knob 30, as shown in FIG. 5 has a stepped interior annular surface, with steps being shown at numeral 36. Insert 34 provides spring fingers 38 which are constructed to tend to spring radially outwardly. When knob 30 is rotated in a clockwise rotational sense, the fingers 38 catch in the steps 36 and the insert 34 is caused to thereby rotate with knob 30 as a unit. When knob 30 is rotated in the counter-clockwide sense however, steps 36 push the fingers 38 radially inwardly and the insert 34 is not rotated with the knob 30, but remains stationary. Insert 34 provides radially oriented ribs 34A extending integrally with the insert 34 toward the center of rotation. With knob 30, with its insert 34, mounted over the first mount piece 22 which extends proximally from the outside surface of the front panel 4, fingers 22A of piece 22 are located proximate the ribs 34A. When the insert 34 is rotated with knob 30, the fingers 22A are moved radially inwardly and then released by ribs 34A producing the desired sound, which is repeated eight times with each one revolution of knob 30, and which dispenses one merchandise package 60. This sound is designed to be loud enough to alert retail personnel and more importantly is a psychological barrier to the thief as he/she knows that any possibility of stealth is disrupted. Thus, the knob 30 only makes the characteristic noise when merchandise is being dispensed, but not when merchandise is being loaded.

As shown in FIG. 1, the side panels 10 provide a further theft deterrence. Preferably the side panels 10 help to prevent a thief from easily cutting the merchandise 60 off the rod 12 since they restrict physical access to a cutting tool. However, the side panels 10 are short (vertically) enough to provide direct visual access to the rod 12 and merchandise 60. Such short side panels 10 also allows the merchandise packages 60 to extend laterally beyond the side panels 10. In addition, the side panels 10 provide a plurality of connection apertures 10A allowing for multiple units of the present apparatus to be removably engaged with one another in a side-by-side configuration, using common hardware and further increasing the difficulty for a potential thief to forcibly remove merchandise 60 from rod 12.

FIG. 1 shows that an apron 70 may be attached or formed integrally with front panel 4. The apron 70 is used to identify the merchandise, price, and other information useful to the consumer and is generally necessary for making a sale. The apron 70 is also helpful in resisting mechanized frontal attacks by thieves using scissors, cutters and other tools since it tends to block access to the merchandise packages.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. An apparatus for dispensing merchandise packages, the apparatus comprising:

a chassis having a proximal end and a distal end, and a proximally positioned front panel, and a distally positioned rear panel;

a knob rotationally engaged through the front panel with an helical coil having a coil turns of a uniform size, the helical coil extensive distally into adjacency with the rear panel; and a rod secured to the rear panel, the rod extensive proximally within the helical coil into adjacency with the front panel; a selected space formed between a proximally positioned end of the rod and the front panel;

wherein, the helical coil and the rod are mutually coextensive except for the selected space between the proximally positioned end of the rod and the front panel;

whereby, with the merchandise packages slidingly mounted on the rod, rotation of the knob and helical coil causes the merchandise packages to slide along the rod disengaging therefrom at the selected space.

2. The apparatus of claim 1 wherein the rear panel has a means for mounting the apparatus in a cantilevered attitude extending proximally from a supporting panel.

3. The apparatus of claim 1 wherein the chassis further comprises a pair of opposing side panels, the helical coil and the rod positioned between the side panels.

4. The apparatus of claim 1 further comprising a noise making mechanism engaged with the knob and enabled for making a noise by rotation of the knob.

5. The apparatus of claim 4 wherein the noise making mechanism includes a first part incorporated within the knob, and a second part incorporated in a knob mount, the first and second parts configured for producing the noise when brought into mutual rotational contact.

6. An apparatus for dispensing merchandise packages, the apparatus comprising:

a chassis having a proximal end and a distal end, and a proximally positioned front panel, and a distally positioned rear panel;

a knob rotationally engaged through the front panel with an helical coil having coil turns of a uniform size, the helical coil having a plurality of sequentially aligned coil turns, the helical coil extensive distally into adjacency with the rear panel; and a rod secured to the rear panel, the rod extensive proximally within the helical coil into adjacency with the front panel; a selected space formed between a proximally positioned end of the rod and the front panel, the merchandise packages slidingly engaged with the rod and positioned between adjacent ones of the coil turns;

wherein, the helical coil and the rod are mutually coextensive except for the selected space between the proximally positioned end of the rod and the front panel;

whereby, rotation of the knob and helical coil causes the merchandise packages to slide along the rod disengaging therefrom at the selected space.

7. The apparatus of claim 6 wherein the rear panel has a means for mounting the apparatus in a cantilevered attitude extending proximally from a supporting panel.

8. The apparatus of claim 6 wherein the chassis further comprises a pair of opposing side panels, the helical coil and the rod positioned between the side panels.

9. The apparatus of claim 6 further comprising a noise making mechanism engaged with the knob and enabled for making a noise by rotation of the knob.

10. The apparatus of claim 9 wherein the noise making mechanism includes a first part incorporated within the knob, and a second part incorporated in a knob mount, the first and second parts configured for producing the noise when brought into mutual rotational contact.

* * * * *